United States Patent [19]

Martin

[11] 4,228,489

[45] Oct. 14, 1980

[54] PORTABLE STAND APPARATUS FOR ELECTRIC FLOOD LIGHTS

[76] Inventor: Edward D. Martin, 3215 S. 84th St., Milwaukee, Wis. 53227

[21] Appl. No.: 16,624

[22] Filed: Mar. 1, 1979

Related U.S. Application Data

[63] Continuation-in-part of Ser. No. 788,817, Apr. 19, 1977, abandoned.

[51] Int. Cl.[3] ..... F21J 21/14

[52] U.S. Cl. ..... 362/250; 362/413; 362/414; 362/418; 362/431; 362/396; 362/449

[58] Field of Search ..... 362/250, 396, 413, 418, 362/414, 449, 431, 121

[56] References Cited

U.S. PATENT DOCUMENTS 2,165,562 7/1939 Mack et al. ..... 362/250 X

*Primary Examiner*—Stephen J. Lechert, Jr.

*Attorney, Agent, or Firm*—Alter and Weiss

[57] ABSTRACT

An improved portable stand for electric floodlights has a base, a series of self-locking interconnected poles, a crossbar for the support of electric floodlights, an adjustable crossbar bracket for positioning the crossbar as desired, adjustable lamp brackets for directing the light at a desired angle, and cord guides for the restraint of a removable electric cord on the exterior of the device.

10 Claims, 4 Drawing Figures

14
15
34
33
16
13
55
45
18
27
51
10
17
10a
30
31
28
29
12
26
7
10
32
26
10b
52
12
11
25
9
23
18
24
19
50
49
47
46
48
45
20
21
22
44
8

PORTABLE STAND APPARATUS FOR ELECTRIC FLOOD LIGHTS

This is a continuation-in-part of my application Ser. No. 788,817, filed Apr. 19, 1977, now abandoned.

This invention relates generally to electric floodlight devices and more particularly to portable stands for such devices.

The invention of the electric light has enabled the selective illumination of vast areas, both indoors and outdoors. This has resulted in the installation of literally billions of electric lights for homes, offices, industrial complexes, arenas, stadiums, streets and highways. The result has been a more pleasant environment in which to live and work, as well as more efficient activities within these areas.

A continuing problem in the area of illumination, however, has been the placement and direction of lighting devices so as to provide a maximum volume of illumination utilizing a minimum number of fixtures, and as small a wattage as possible. A particular area of difficulty has been use by auto mechanics, electricians and other tradesmen who are required to work at various locations on problems requiring clear vision. In these situations there is frequently inadequte light available from the ordinary fixtures at that location. On some occasions there is no lighting provided at all. Similarly, certain professions, such as tool and die making and engraving, require placement of lighting devices in extremely close proximity to the work being completed.

Some of the efforts in the past to overcome these difficulties have included cord type lamps designed to be hung from a hook, and clamp type devices which attach to available objects. These devices, while beneficial, have presented difficulties in finding an available object to attach to, and more frequently, the object not being positioned as close to the point of use as desired. The use of hanging cord type lamp has also presented a difficulty in firmly positioning the lamp out of the way of the user.

An additional problem has been that these affixed floodlight devices having interior wiring with a limited number of circuits. This has resulted in a restriction as to the number of floodlights that may be utilized, as well as preventing the use of the device for other electrical implements.

Therefore, my invention has the following objects:

To provide a portable stand apparatus for electric floodlights which enables selection of the desired number of lights utilized in a single stand mechanism;

To provide a portable stand apparatus which enables placement of individual or multiple floodlamps in positions as close to the desired point of use as needed;

To provide such floodlight stand devices which are collapsible for easy transportation and storage;

To provide such floodlight stand devices which are inexpensive to manufacture and purchase;

To provide such floodlight stand devices utilizing mechanisms which are adjustable as to height, extension from the device, and angle of the lamp or lamps utilized;

To provide portable floodlight stand devices which are easy and quick to assemble for use;

To provide portable floodlight stand devices which resist tipping or sliding when bumped;

To provide such floodlight stand devices utilizing common heavy-duty extension cords affixed to the exterior of the device in order to allow the use of such extension cords for a multiplicity of purposes, and to allow the lights to be removed from the device and hung by the cord, if desired.

SUMMARY OF THE INVENTION

The present invention is an improved portable stand device for electric floodlights. The invention comprises a base, a number of interconnected poles supported by the base, a crossbar bracket adjustable along said poles, a sliding crossbar held by said bracket, and a plurality of lamps attachable to the crossbar. The invention includes a removable extension cord held by a pair of cord guides, one attached to the crossbar bracket and another attached to the base. Also attached to the cord is a multi-plug adapter which enables supply of electricity to a plurality of electric lights or other electrical devices. An additional feature of the invention is the inclusion of spring-loaded pin mechanisms within the interconnecting poles to lock the poles together.

In one embodiment of the invention, the previously mentioned base is formed as a flat, heavy steel plate which has been stamped into a somewhat V-shaped configuration. This arched configuration causes the edges of the base to be angled into the area of placement of the base, thus inhibiting movement of the device. A pole support housing is attached to the top of the base. The pole is telescopically received by the housing. A spring-loaded pin restrains the pole within the housing by the insertion of the pin through an aperture.

In one embodiment, the poles comprise a plurality of hollow tubes having a reduced diameter at one end. A rounded pin member is slidingly positioned in and extends from the side of each pole. A curved spring attached to one end of the pin member is of sufficient length to press against the inside of the pole with its opposite end. A receiving slot is found at the top of each pole. When two poles are interconnected, the rounded pin member of one pole extends into the receiving slot of another pole, and locks the two poles together. Thus, the device may be quickly and easily assembled, disassembled and stored. Further poles may be added or removed in order to place the lights at a desired height.

In a preferred embodiment of the invention, the previously mentioned crossbar has a rectangular arm, having a smooth surface. A plurality of holes are drilled through this arm and allow the attachment of the floodlights by utilizing a bolt and nut arrangement to the lights themselves.

In an additional embodiment of the invention, the crossbar further includes a plurality of hooking mechanisms designed to be inserted through the holes in the crossbar for the temporary support of tools and equipment.

In a preferred embodiment of the invention, the sliding crossbar bracket which holds the crossbar to the interconnecting poles includes a pair of plate members. These plate members are interconnected by a number of spacing stud members. The exterior surface of these stud members is smooth and round, so that the crossbar member can be slidingly receiving in the area between the two plates, utilizing the studs as an anti-friction device.

A pair of clamp members terminate in clamp feet at one end, and are attached at said feet to the back of one plate. These clamps are substantially semi-circular. A pair of flanges project from a second end of said clamp members, and a tightening knob and bolt are positioned to draw said flanges toward one another when said knob is tightened on said bolt. The clamp members are positioned to telescopically receive the previously mentioned pole means.

A tightening bolt, having a threaded extension, is threaded through the flanges thus utilizing the clamp members to grip the pole, thereby supporting the crossbar bracket on the pole and positioning the crossbar member to a desired height. The tightening bolt also exerts pressure through the clamp feet and indirectly against the crossbar bracket itself, thereby holding the crossbar itself in place.

In a preferred embodiment, the above described clamp may also act to depress said spring-loaded pins as the clamp is passed along the assembled poles to enable the pole sections to be disassembled. An alternative clamp configuration has a cut out shaped to allow the clamp to pass over said pins without depressing said pins.

In an additional embodiment of the invention, the previously mentioned cord guides include an anti-tip holder attached to the base of the device. Said cord holder, in a preferred embodiment, comprises a looped wire member somewhat resembling a spring. One end of this looped wire member is fixedly attached to the base member. An electrical extension cord, running to the lamps on the device, may be fixedly positioned through the loop, without requiring the cord to be threaded through the loop, thereby holding the cord in place along the floor and directing it upward along the length of the poles of the lamp.

In an additional embodiment of the invention, the cord guides further include an upper cord guide fixedly attached to the crossbar bracket. The upper cord guide is also constructed of rounded wire. However, the upper cord guide is shaped as a hook, at a first end through which the electric cord runs. At a second end of the upper cord guide is an offset loop which is positioned around the threaded extension of the clamp tightening bolt. As the tightening bolt is threaded through the threaded flanges on the crossbar bracket, this offset loop acts as a lock-nut to fixedly hold the upper cord guide in place. The crossbar may thereby by extended in either direction without displacing the electric cord from the device, because the cord runs through the hooked extension of the upper cord guide without being fixedly held in place.

DETAILED DESCRIPTION OF THE DRAWINGS

Figures 1, 2, 3, 4:
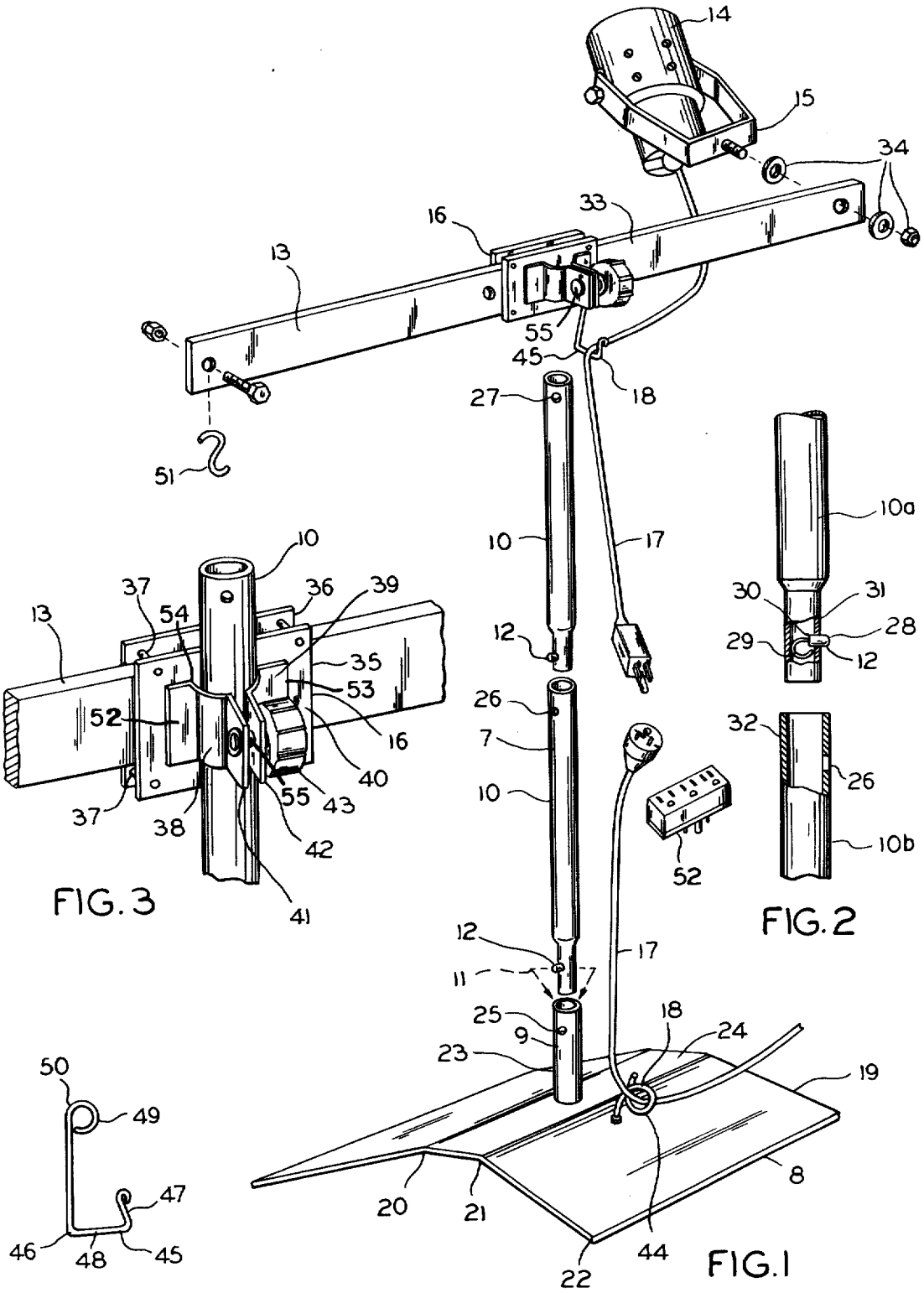
FIG. 1 of the drawings is a front perspective view of an improved portable stand apparatus for electric floodlights.
FIG. 2 of the drawings is a side perspective view of the crossbar bracket, showing in particular, the spacing stud members, in relationship to the crossbar member and the circular clamp means fixedly attached to the pole.
FIG. 3 of the drawings is a front cutaway view of stop means showing, in particular, a curved spring member fixedly attached at one end to a rounded sliding pin member and pressing against the inside surface of the pole means with its second end.
FIG. 4 of the drawings is a front view of an upper cord guide means, showing in particular, L-shaped hooking means at a first end and offset loop means at a second end.

While this invention is susceptible of embodiment in many different forms, there is shown in the drawings and will herein be described in detail, several specific embodiments, with the understanding that the present disclosure is to be considered as am exemplification of the principles of the invention and is not intended to limit the invention to the embodiments illustrated.

Improve portable stand apparatus for electric floodlights 7, as shown in FIG. 1, includes a base 8 for the support of the device. A socket is fixedly attached to base means 8 and is used to support a plurality of interconnecting poles 10 telescopically received by socket 9, as illustrated at 11. Stop means 12, attached to poles 10, restrain each said pole within either socket 9, or another pole 10. Crossbar 13 is used for the positioning and support of lamp 14. A plurality of lamp brackets 15 are used for the positioning and support of lamp 14 on crossbar 13.

Removable extension cord 17 is used to supply electricity to electric light 14. Cord guides 18 are used for the restraint of removable cord 17 on portable stand apparatus 7. A multi-adapter 19 may be removably attached to cord 17, in order to provide electricity to a plurality of electric floodlights or other electrical equipment.

As shown in FIG. 1, base 8 comprises a flat heavy steel plate member 19, arched along lines 20 and 21. Plate member 19 has edges 22, designed to angle into the area of placement of base 8. This angular placement results in a friction effect of the edges 22 on the ground.

As further shown in FIG. 1 of the drawings, pole socket 9 includes a tubular housing member 23, attached to a first side 24 of base means 8. Pin receiving aperture 25 runs through one side of tubular housing member 23. Tubular housing member 23 telescopically receives pole 10 and restrains pole 10 therein by stop means 12.

Stop means 12 includes a plurality of pin receiving apertures 25, 26 and 27 formed through pole socket 9 and poles 10. A rounded pin member 28 is slidingly positioned and extends from each pole 10. As shown in FIG. 2, rounded pin member 28 is telescopically received by pin receiving aperture 26, for example, when first end 31 of pole 10*a* is telescopically received by a second end 32, of pole 10*b*.

In a preferred embodiment of the invention, crossbar 13 is formed as a rectangular arm 33, having a smooth surface and a plurality of lamp mounting means 34 for attaching lamp bracket 15 and lamp 14 to crossbar means 13.

As shown in FIG. 1, crossbar 13 further includes means 51 to mount tools on arm member 33.

As shown in FIG. 3, crossbar bracket 16 comprises a pair of plate members 35 and 36. A plurality of spacing stud members 37, fixedly connects plate members 35 and 36. Spacing stud members 37 also hold plate members 35 and 36 at a distance apart. Spacing stud members 37 are rounded to facilitate the sliding of crossbar 13.

A pair of clamp members 38 and 39 are fixedly attached to a first side 40 of plate member 35 by clamp feet 52 and 53. Clamp members 38 and 39 are positioned so as to receive pole 10 therebetween. Clamp members 38 and 39 terminate in flanges 41 and 42, respectively. Tightening knob 43 is adjustably attached through apertures in flanges 41 and 42 onto bolt 55 so as to grip pole 10 at a desired height. Tightening knob 43 also exerts pressure against plate member 35 to deflect said plate member and thus fixedly restrain crossbar 13 within crossbar bracket 16.

Movement of crossbar bracket 16 along poles 10 may bring bracket members 38 and 39 in contact with stop members 12, at each site where one pole 10 is joined to another pole 10. It is contemplated that means be provided to pass bracket 16 over said stop members 12, insuring that crossbar 13 may be positioned at any point along poles 10.

In one arrangement, stop members 12 are rounded sufficiently to enable bracket members 38 and 39 to depress said stop members as bracket 16 is passed thereover. Another contemplated embodiment includes channel 54 formed on bracket assembly 16 to enable said bracket to pass over said stop members as shown in FIG. 3. In this second embodiment, if bracket 16 is rotated such that stop members 12 do not align with channel 54, bracket members 38 or 39 will interrupt the travel of bracket 16, thus limiting the distance through which bracket 16 may fall, by engaging stop members 12.

Returning again to FIG. 1, cord guide 18 includes anti-tip cord holder 44, attached to base 8, for the restraint of cord 17 on said base, and also to enable cord 17 to be disposed horizontally from base 8 to prevent tipping of the apparatus.

In an additional embodiment of the invention, cord guide 18 further includes an upper cord guide 45 fixedly attached to crossbar bracket 16 for directing cord 17 along apparatus 7. Upper cord guide 45 further enables the rapid installation and removal of a plurality of electric floodlights 14, as desired.

As shown in FIG. 4, upper cord guide 45 includes a round wire member 46, having hook 47 formed at a first end 48. Offset loop 49 is formed at a second end 50, of rounded wire member 46. Offset loop means 49 is supported on crossbar bracket 16 by tightening knob 43, (not shown). When offset loop 49 is positioned on tightening knob 43, offset loop 49 operates as a locknut mechanism, fixedly positioning upper cord guide 45 on crossbar bracket 16.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

I claim:

1. In a portable stand for the positioning of floodlights having power cords, said stand of the type having an upright and a horizontal arm supported by said upright, the improvement comprising:

a base to support said upright, said base being generally rectangular, with four edges, said base being shaped into a generally V-shaped arched configuration;

said base having two opposed edges which contact the surface upon which said base rests, said V-shaped configuration angling said two edges of said base onto the area of placement of said base.

2. The apparatus as recited in claim 1, wherein said upright includes at least one pole member, said pole member having a first and a second end, said pole member being reduced in diameter at said first end;

means protruding from said pole member proximate said first end to retain said pole member with another of said pole members; and said engagement means of one said pole member being registrable with said retaining means of a second of said pole members when said first pole member is telescopically assembled to said second pole member.

3. The invention according to claim 2 in which said retaining means include:

a rounded pin member slidingly positioned within and protruding from said pole member; and means biasing said rounded pin member to maintain said rounded pin member in an extended position protruding from said pole member.

4. The apparatus as recited in claim 1 wherein said apparatus further includes:

a crossbar bracket holding said arm to said upright;

means to clamp said crossbar bracket to said upright, said clamp means having a pair of substantially U-shaped members each having a first end and a second end:

a clamp foot member integrally formed to said first end of each of said U-shaped members, said clamp foot member being fixedly attached to a first side of said crossbar bracket, said U-shaped members being positioned so as to receive said upright therebetween;

each said second end having an aperture formed therethrough; and a threaded tightening bolt adjustably engaged through said pair of said apertures, a knob threaded onto said bolt for the selective tightening of said crossbar bracket on said upright at a desired height, said clamp means exerting a force through said clamp foot members and against said first side of said crossbar bracket, thereby restraining movement of said horizontal arm.

5. The apparatus as recited in claim 4 wherein said crossbar bracket further includes first and second plate members each said clamp foot member being attached to a first side of said first plate member, said U-shaped members positioned to receive said upright therebetween, said second plate member disposed parallel to the second side of said first plate member, said first and second plate members joined one to the other in fixed spatial relationship to allow said crossbar to pass slidingly therebetween, said first plate member deflecting when said knob is tightened on said tightening bolt to maintain said crossbar in a selected position.

6. The apparatus as recited in claim 1 wherein said improvement further includes means on said stand to hold said power cords.

7. The invention according to claim 6, in which said cord holder means includes:

means on said base to hold said power cord, said base cord holder means enabling said cord to be disposed horizontally from said base, thereby disposing said cord along the ground so as to prevent tripping on said cord.

8. The invention according to claim 6, in which said cord holder means further includes:

an upper cord guide fixedly attached to said horizontally arm to channel said cord along said crossbar and down said upright, said upper cord guide further enabling the rapid support or removal of said cord from said stand.

9. The invention according to claim 8, in which said upper cord guide further includes:

a round wire member;

a hook formed at a first end of said round wire member to reduce the tendency of said cord to slip off said upper cord guide;

offset loop of said upper cord guide formed at a second end of said round wire member, said offset loops allowing for the non-clamping support of said upper cord guide to said lamp stand.

10. The apparatus as recited in claim 4 wherein said U-shaped members include a channel formed therealong said channel shaped and sized to enable said U-shaped members to pass over said retaining means without engaging said retaining means.

* * * * *